US007143451B2

(12) United States Patent
Lundgren

(10) Patent No.: US 7,143,451 B2
(45) Date of Patent: Dec. 5, 2006

(54) HAT INCLUDING ACTIVE VENTILATION

(76) Inventor: Lennart E Lundgren, P.O. Box 33283, Northglenn, CO (US) 80237

( * ) Notice: Subject to any disclaimer, the term of this patent is extended or adjusted under 35 U.S.C. 154(b) by 134 days.

(21) Appl. No.: 10/742,027

(22) Filed: Dec. 19, 2003

(65) Prior Publication Data

US 2005/0132468 A1 Jun. 23, 2005

(51) Int. Cl.
*A42B 1/24* (2006.01)

(52) U.S. Cl. ..... 2/171.3; 2/209.13

(58) Field of Classification Search ..... 2/171.3, 2/209.13; 62/259.3
See application file for complete search history.

(56) References Cited

U.S. PATENT DOCUMENTS 3,353,191 A * 11/1967 Dahly ..... 2/171.3
4,238,857 A 12/1980 Waters
4,551,857 A * 11/1985 Galvin ..... 2/7
4,680,815 A * 7/1987 Hirsch et al. ..... 2/171.3
4,893,356 A * 1/1990 Waters ..... 2/171.3
5,425,620 A * 6/1995 Stroud ..... 416/63
6,032,291 A * 3/2000 Asenguah et al. ..... 2/171.3
6,055,666 A * 5/2000 Eklund et al. ..... 2/9
6,634,031 B1 * 10/2003 Schlapkohl ..... 2/209.13
6,760,925 B1 * 7/2004 Maxwell ..... 2/171.3

* cited by examiner

*Primary Examiner*—Katherine Moran
(74) *Attorney, Agent, or Firm*—Leyendecker and Lemire, LLC; Kurt Leyendecker

(57) ABSTRACT

A hat including an encased fan unit and an array of solar cells is described. In a preferred embodiment the fan unit is a low profile fan unit having a total thickness of less than 15 mm. The fan is typically located on the back of the hat's body providing airflow over the head and through the hair of a wearer thereby facilitating evaporative cooling processes. The array of solar cells is arranged the surface of a brim of the hat and comprises flexible thin film type solar cells. Preferably, the solar cells are electrically connected in a series parallel relationship.

18 Claims, 3 Drawing Sheets

HAT INCLUDING ACTIVE VENTILATION

FIELD OF THE INVENTION

The invention relates generally to headwear, and more particularly to a hat including a fan for actively ventilating the interior portion of the hat when worn by a user wherein the fan is preferably powered by solar cells.

BACKGROUND

Numerous solar-powered hats and other headwear have been designed with the intent of cooling the head of a wearer. A fan is typically placed on a brim of the hat or at an intersection of the hat's body and its brim so that the fan blows air onto the user's forehead or face, such as the headwear described in U.S. Pat. Nos. 6,032,291 ('291) and 4,893,356 ('356). There are several disadvantages of placing the fan unit in one of these locations.

First, a fan unit placed on the front brim or lower body portion of a hat is readily noticeable to others and is typically not very fashionable. Certainly, a fan unit placed at the front of the hat significantly detracts from the visual appeal of the associated piece of headwear. Accordingly in the prior art, solar-powered fan units have not been incorporated into fashion headwear and are generally relegated to novelty baseball caps and novelty safari pith helmet-style hats. Even if a wearer is unconcerned about the fashion issues presented by the fan unit, the solar cell panels are an additional detractor from the fashion desirability of a solar-powered hat. Typically, one or more solar cells are placed directly on the top of the hat or cap, such as is described in the '291 and '356 references. Given the unique look of solar cells, the true nature of the hat is revealed. In summary, the blatantly obvious fan combined with the equally obvious solar cells make the prior art solar-powered fan-cooled hat a novelty item that the great majority of hat wears would not consider wearing for fear of ridicule or chastisement.

Another problem of the prior art solar-powered fan caps is the manner in which the air from the fan is directed. In the cap of the '291 reference, the air is blown directly into a wearer's face. In the helmet of the '356 reference, the air is blown on the wearer's forehead and it washed therefrom over his/her face. While blowing air on or across a wearer's face may not be as problematic in the humid climate of the eastern half of the United States, it is particularly undesirable in the hot dry climates of the western United States. Specifically, the dry air acts to dry out the eyes of the wearer, which can make the wearer uncomfortable especially if he/she is wearing contact lenses. Further, by blowing a significant portion, if not all, of the air from the fan over or at a wearer's face, the air is not being utilized as efficiently as it could be to actively cool the wearer.

In the dry western climates, evaporative cooling is a particularly effective method of cooling whether used to cool individuals or entire buildings. By blowing hot dry air over or through a moist environment, the water evaporates thereby cooling the surrounding area through the transformation of heat energy into the latent heat of evaporation of the water. Generally, to most effectively to cool using evaporative cooling, dry air is passed over moist surfaces having relatively large surface areas. Typically, a person's face is neither particularly moist nor does it have a relatively large surface area. In contrast, when a person is hot, he/she typically sweats on the top of his/her head wherein a thin layer of water coats the person's strands of hair. Ideally, a fan of a solar-powered hat would blow air across the top of a wearer's head and/or through his/her hair.

The headwear of the '356 reference attempts to direct some of the fan's flow over the top of the head, although a significant portion is directed downwardly over the wearer's eyes and face. For additional potential cooling a moistened cooling pad is provided between the wearer's head and the bottom surface of the headwear's topside. Unfortunately as described below, several design flaws prevent the headwear taught in the '356 patent from being very effective.

In order for a fan to blow air effectively around the head, the fan must be capable of operating under static pressure conditions. Typically, once one starts blowing air into a confined space with limited air outlet locations, such as the area in a piece of headwear between the top of a wearer's head and the topside of the hat, the pressure in the confined space increases to a level greater than that of the ambient air. The airflow from the fan will then attempt to flow along a path of least resistance or away from the higher-pressure region. It is to be appreciated that the pressure differential need only be very small to cause the air to be diverted from flowing into a higher-pressure region. Considering the type of fan blades taught in the '356 reference and considering the placement of the fan relative to the inlet opening, the great majority of the air flow from the fan would be directed downwardly over the wearer's face or back around the outside of the fan blades (or impellers) and away from the wearer.

Additionally, to even gain a small amount flow of air over the head despite the static pressure difference, the motor must be relatively powerful when compared to the motors of headwear that exclusively blows a stream of air onto a wearer's face. Understandably, the more powerful the motor the more energy it utilizes. Accordingly, the headwear taught in the '356 reference requires the use of a battery power pack in addition to the solar panel, since the small solar panel taught in the reference cannot generate enough energy alone to operate the fan effectively. Further, because of the configuration of the headwear, there is not any effective place on the headwear to place additional solar cells. In general, concerning the construction type helmet taught in the '356 reference, the additional weight of a battery pack is not very significant, but when considering other lighter styles of hats more commonly worn by people recreationally, the additional weight of a battery pack could become burdensome and, perhaps more significantly, prevent a potential buyer from purchasing or using the headwear in the first place.

SUMMARY

One embodiment of the present invention comprises a piece of headwear. The headwear includes a body portion that, when the headwear is being worn, substantially covers the top of a wearer's head, and provides a cavity between the top of the wearer's head and a topside of the body portion. The headwear also includes a low profile encased fan unit that is attached to the body portion and positioned to direct airflow through the cavity.

Another embodiment of the invention also comprises a piece of headwear. The headwear includes a body portion, a brim generally surrounding the body portion. The headwear also includes a fan that is attached to the brim or the body portion, and an array of solar cells. The array of solar cells is attached to a top surface of the brim and is electrically coupled to the fan.

Yet another embodiment of the invention also comprises a piece of headwear. The headwear includes a body portion, a brim, an encased fan unit, and a plurality of thin film flexible solar cells. The brim extends substantially around the body portion. The fan unit is attached to the body portion and is adapted to provide airflow in an interior of the body portion. Finally, the flexible solar cells are arranged around a surface of the brim

DETAILED DESCRIPTION

An Overview

Figure 1:
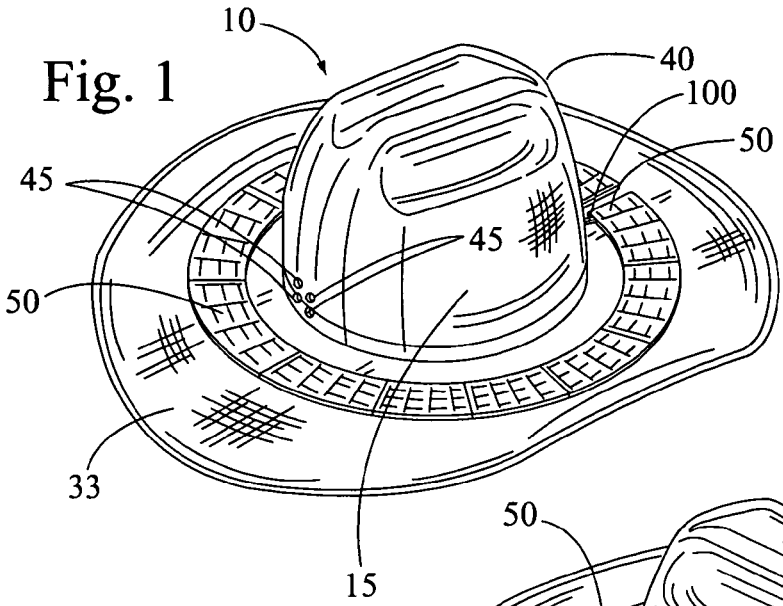
FIG. 1 is an isometric front view of a first preferred embodiment of the present invention comprising a cowboy style hat.

Headwear incorporating a cooling fan that blows air directly over or across the top of a wearer's head to provide: (1) active evaporative cooling and/or (2) a cooling breeze is described. In the preferred embodiments, a low profile encased fan unit of the type typically used to cool electronics enclosures is utilized. Because rotor and impellers of the fan unit substantially span the opening in the fan unit's case, there is little room for airflow to be diverted from the higher-pressure region inside of the headwear. Accordingly, this type of fan can support pressure differentials between ambient and the pressure in the region inside the headwear between the headwear's topside and the top of a person's head. Because the air flows across the top of the wearer's head and through his/her hair, evaporative cooling is facilitated effectively cooling the head of the wearer.

Preferably, the fan unit is mounted on the backside of the headwear where it will not be visible to a person facing the wearer of the headwear. In some embodiments, the fan unit's housing, rotor and impellers all have the same color as the associated hat, such that the fan unit visually tends to blend in with the headwear. To direct the flow of air in the hat, vents can be provided along the front and/or side surfaces of the hat. Typically, these vents comprise small grommetted holes similar to those commonly found on certain types of headwear, so the vents are not particular obtrusive.

A first preferred embodiment, as described in detail herein below, comprises a cowboy-style hat with a large brim. Typically, the edges of the brim on these types of hats are upturned slightly such that the top surface of the brim is not readily visible to a person when a wearer is standing and holding his/her head in a normal upright position. The large expanse of the brim provides a significant amount of surface area for mounting a significant number of solar cells thereon without making the solar cells particularly obvious to a casual observer. The solar cells of the first preferred embodiment comprise flexible thin film cells that are preferably fabricated in a ringed configuration to fit flushly against the brim and substantially encircle the body of the hat. When the hat is black, the solar cells blend with the hat and to the casual observer, the pattern of the cells can appear to be a design woven, embossed or printed on the hat.

The importance of making the fan unit and solar panels in the first preferred embodiment and variations thereof as unobtrusive as possible cannot be over emphasized particularly concerning cowboy and similar style hats. It is appreciated that cowboy style hats are often worn by persons who work outdoors but are of the personality that would not wear a gimmicky solar powered hat. However, these same people would potentially benefit from and appreciate the cooling provided by a solar-powered hat. The likelihood that such a person would purchase such a hat is greatly increased if the fan and solar cells are not immediately obvious and blend into the hat.

A second preferred embodiment, as described herein below, comprises a construction-style safety helmet that is battery powered. The use of batteries, and specifically the weight of the batteries, is not a substantial hindrance in this type of headwear given that the headwear is already relatively heavy and it is worn primarily for safety reasons. Certainly, the cooling benefits and the additional comfort provided therefrom more than outweigh any concerns over the minor increase in weight of the helmet when compared to a traditional safety helmet that is not cooled. Typically, the battery pack is located in the helmet on the underside of the helmet's body; however, in variations the battery pack can be provided at any suitable location. Like the other preferred embodiments, the second preferred embodiment utilizes an encased fan mounted to back side of the helmet to provide air flow over a wearer's head to facilitate evaporative cooling.

Terminology

The term "or" as used in this specification and the appended claims is not meant to be exclusive rather the term is inclusive meaning "either or both".

The term "fan" as used herein refers to any suitable device that actively provides an increased flow of air in a particular direction. Typically, a "fan" has a rotational axis and a powered impeller or blower unit that facilitates the airflow.

The phrase "encased fan" as used herein refers to a fan that includes a casing that at least partially encloses the periphery of the impeller or blower unit such that airflow exiting the impeller traveling in a first direction cannot easily change its direction and flow back around the outside of impeller or blower. The encasement of the fan thereby facilitates the operation of the fan in static pressure conditions.

The phrase "low profile encased fan", as used herein, refers to a fan wherein the rotor, the impellers and the motor are all substantially enclosed in the unit's casing, and wherein the electrical motor, particularly its windings and associated magnets, are located at axial positions substantially directly radially underlying the rotor and its impellers. Typically, in this type of unit, the magnets of the motor are (1) attached directly to rotor from which the impellers radiate, and (2) overlie the motor's windings. Also typically, the axial thickness of the impellers is roughly similar to the axial dimension of the electrical motor's core (i.e. windings and magnets). This type of fan unit is contrasted from fan units that comprise a rotor and impeller unit attached to the end of a rotational shaft that extends axially from an electrical motor.

The terms "hat" and "headwear" are used interchangeably herein and unless otherwise specifically provided for in this specification.

As used herein, the "body" of a hat refers to the portion of the hat into which a wearer's head is at least partially received.

The phrase "body cavity" as used herein refers to the unfilled void in the hat between the bottom surface of the hat's topside and the top of a wearer's head when the hat is being worn.

A First Preferred Embodiment

A cowboy-style hat 10 incorporating a solar-powered fan is illustrated in FIGS. 1–5. Referring primarily to FIGS. 1–4, the hat includes a relatively tall body 15 that forms a body cavity 20 between a wearer's head 25 and the topside 30 of the body when worn, and a brim 33 that extends around the entire periphery of the body. An encased fan unit 35 is mounted to the body on the backside 40 of the hat generally proximate the topside such that airflow from the fan is directed either in or out of the body cavity. One or more air inlets/outlets 45 can be provided at various locations on the hat's body to direct the airflow from the fan. Finally, a ringed array of flexible substrate solar cells 50 is attached, usually with an adhesive, to the top surface of the brim.

Figure 4:
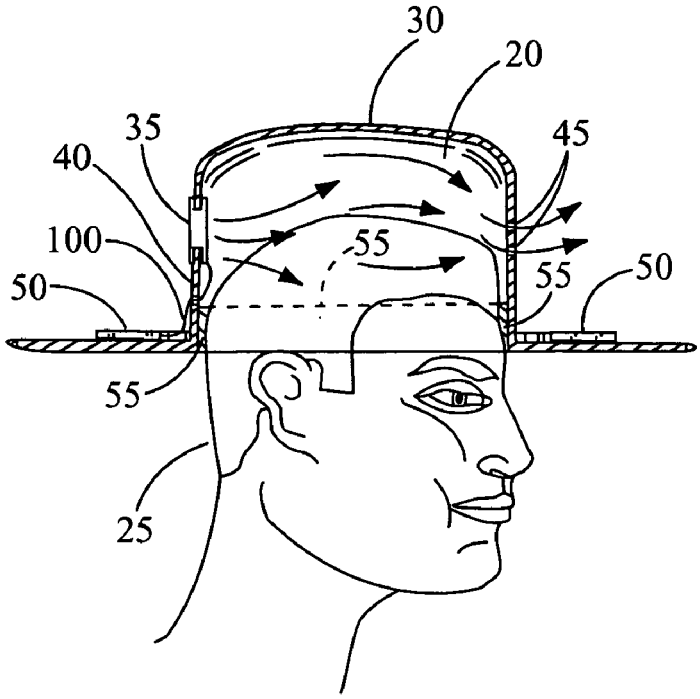
FIG. 4 is a cross sectional side view of the first preferred embodiment of the present invention illustrating the hat on the head of a wearer.

The body 15 and brim 33 of the hat are comprised of any suitable materials such as felt, straw, leather, fabric, synthetic material, or any combination thereof. In one variation of the first preferred embodiment, a woven body and brim has been found to be particularly effectively for use with the fan unit 35 and the ringed solar cell array 50. The body and brim can have any desired color but by using a black body and brim, the black case of the fan unit 35 and the black solar cells tend to become less obvious. Incidentally, although a black body and brim is more likely to absorb heat, the cooling effectiveness of the first preferred embodiment is typically more than sufficient to mitigate any deleterious effects of the dark color. The body typically includes a sweatband/headband 55 along the periphery of its opening into which a wearer's head 25 is received. As best shown in FIG. 4, the headband is the interface between the hat's body 15 and the head 25 of the wearer. If the hat 10 is properly fit to the wearer, the headband will be in contact with the wearer's head over most of the periphery of the headband such that a light seal is formed that inhibits the free unforced flow of air between the headband and its points of contact with the wearer's head.

Figure 5:
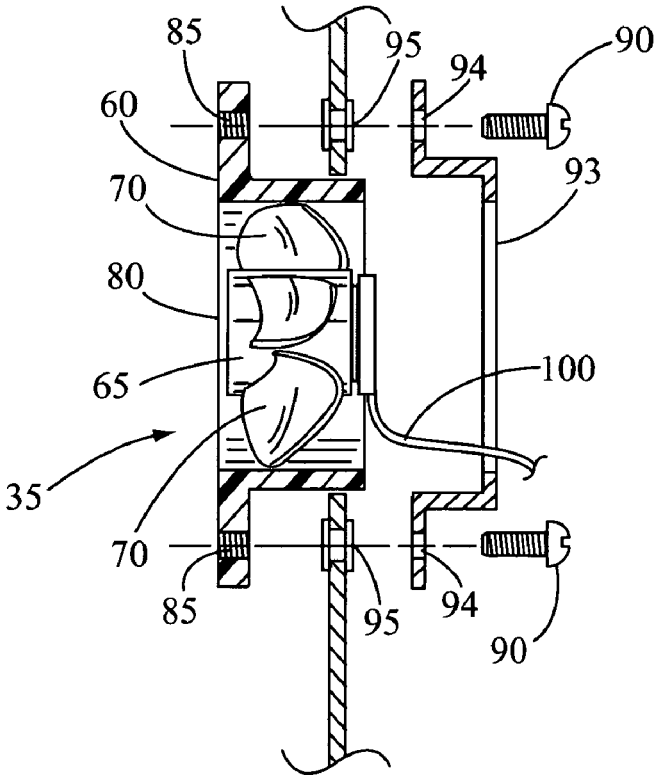
FIG. 5 is partial exploded cross sectional side view of the first preferred embodiment illustrating the attachment of a low profile encased fan unit to the hat.

The fan unit 35, which is typically of the low profile encased variety, is best illustrated in FIG. 5, and comprises a case 60 that encloses a rotor 65 that has a plurality of impellers 70 extending therefrom. The case also includes a flanged portion 75, which extends outwardly from the thicker portion 80 containing the rotor. The maximum thickness of the low profile encased fan unit is preferably less than 15 mm, more preferably less than 12 mm, and most preferably less than or equal to 10 mm. Typically, four threaded bores 85 are provided in the flange at corners thereof to receive a mounting screw 90. A fan guard 93 is also provided that includes holes 94 corresponding with threaded bores of the flange so that the guard can be installed over one side of the case. Ideally, the gating or screening on the guard is fine enough to prevent a wearer's hair from easily passing through it and getting tangled in the rotor. The fan is received through a round opening in the body 15 of the hat. The bores are aligned with four grommeted holes 95 made in the backside wall of the hat's body. The guard is aligned with the grommeted holes from the inside surface of the backside 40 and the mounting screws are placed therethrough, threaded and tightened into the threaded bores. A pair of electrical wires 100 extends from the fan and interfaces with the solar cell array 50.

In the preferred variations of the first preferred embodiment, the fan unit 35 is configured to blow air into the body cavity 20. By blowing air inwardly, the cooling efficiency of the hat is enhanced. Further, one of the potential downside to having the fan suck air out of the body cavity is that the wearer's hair is more likely to be sucked into the fan and cause the wearer difficulty, if not pain, when removing the hat. There are, however, circumstances when a fan that sucks or exhausts the air from the body cavity is preferred over the blowing air into the cavity. Under these circumstances, a guard 93 with a fine screen mesh is typically utilized.

Preferably to facilitate effective cooling, the fan has an airflow capacity rating of at least 1.5 cubic feet per minute (CFM); more preferably at least 2.5 CFM; and most preferably at least 3.5 CFM. Additionally to ensure proper airflow in the enclosed body cavity, the preferred fan unit has a static pressure rating of at least 0.05" of water, more preferably at least 0.08" of water and most preferably at least 0.10" of water. One low profile encased fan unit found to be particularly suitable for use in the first preferred embodiment is Orion Fan model #OD4010-05 MB made by Knight Electronics, Inc. of Dallas Tex. The fan unit is square being about 40 mm long on each side and about 10 mm thick. When mounted on the first preferred embodiment, the fan extends outwardly from the outside surface of the hat's backside 40 about 7 mm or less making the fan relatively unobtrusive. The fan operates on between about 4–8 volts and about 0.07 amps. The fan can operate at a static pressure of up to 0.12" of water and has an airflow rating of 3.8 CFM. Typically, during the operation of the first preferred embodiment, the static pressure will be less than 0.12" of water and the actual flow of air will be reduced somewhat to account for the actual static pressure, but the actual flow of air using this particular fan has proven to be sufficient to keep a wearer comfortable even in temperatures into the nineties and above.

Figure 2:
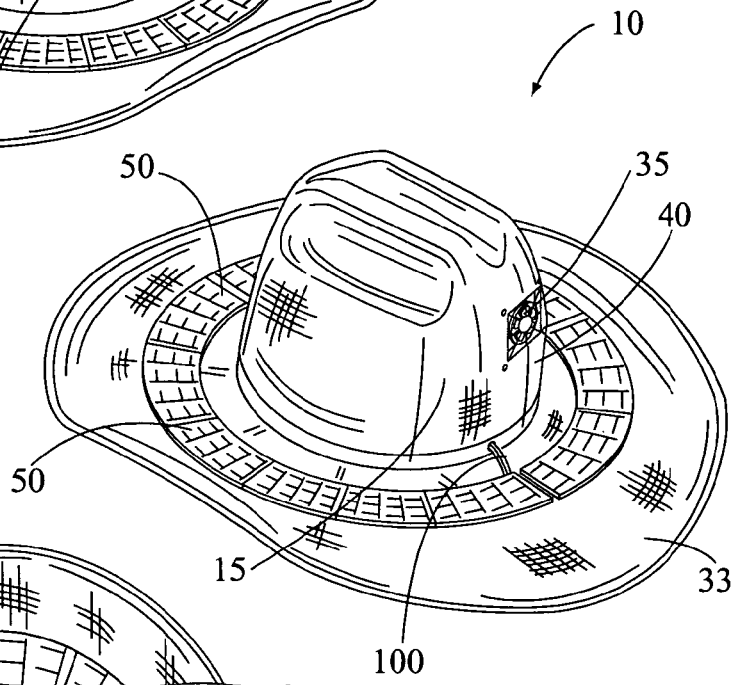
FIG. 2 is an isometric rear view of a first preferred embodiment of the present invention comprising a cowboy style hat.
Figure 3:
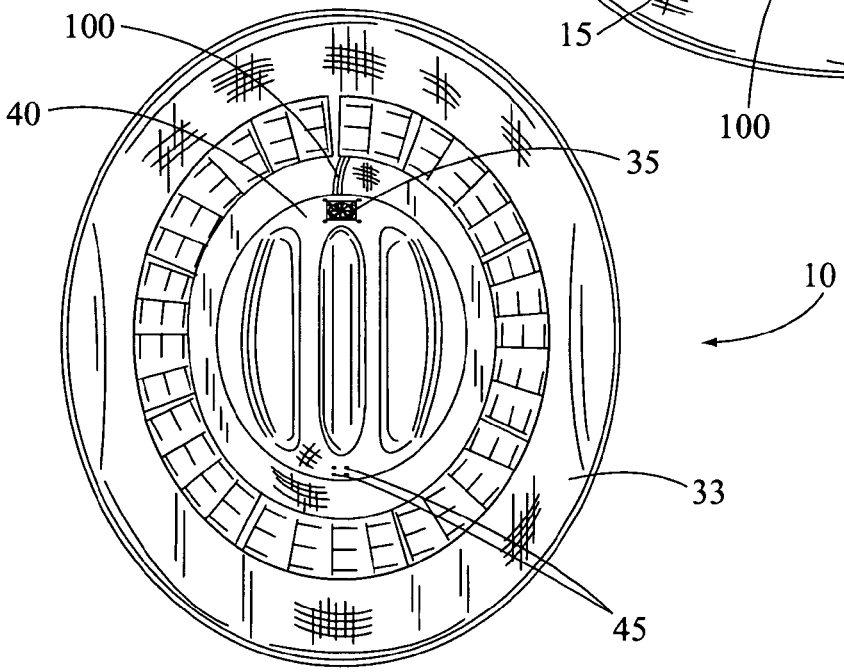
FIG. 3 is a top view of the first preferred embodiment of the present invention.

The ringed solar cell array 50 as best shown in FIGS. 1–3 comprises a plurality of individual cells 105 (see FIG. 7) wired in series parallel. The array 50 is of the thin film type wherein the constituent solar cells materials are typically vacuum deposited and printed onto a thin polyester or other polymeric sheet material to product a very thin and flexible set of solar cells. Flexible thin film solar cells are relatively damage resistant when compared with rigid cells and because of their flexibility can be used on portions of a hat that are somewhat flexible as well without a significant risk of damage to the cells. The array of solar cells is typically attached to the top surface of the brim 33 with either an adhesive or a double sided tape, although other means of attaching the solar cell array can be utilized such as mechanical fasteners, hook and loop material, and sewing. Thin film cells are available commercially in a variety of rectangular sizes, but they can be custom fabricated for specific applications. Although variations of the first preferred embodiment can be produced using individual cells that are wired together, the improved visual appearance combined with easier manufacturability of the resulting hats makes a single ringed array of solar cells desirable. As mentioned above, the regular repeating pattern of the cells on the ringed array substrate can appear to the casual observer to be a pattern provided on the hat for fashion purposes, and accordingly, the casual observer may not realize the true functional nature of the array. As a variation of the fully ringed array as shown, two solar cell arrays can be provided that each comprise half of a ring that when applied to the brim, the two half ring arrays are butted against each other at the front and rear portions of the brim.

The array is electrically coupled with the fan by way of a set of two wires 100 that typically extend from the butted ends of the ringed array 50 and into the body 15 of the hat proximate its intersection with the brim 33. From the intersection, the wires run up inside the backside 40 of the body and attach to the fan unit 35. In variations using individual cells distributed over the brim of the hat, the wires extend inwardly along the brim into the body and are routed behind the headband 55 to a point along the backside wherein they extend upwardly to the fan unit. In other variations using the half ringed arrays, a set of wires extends from the back end of each of the arrays into the body and upwardly to the fan unit. When a straw or woven cowboy-style hat is utilized, the wires, which are preferably the same color as the brim and body, can be interwoven into the brim to further disguise them.

Figure 7:
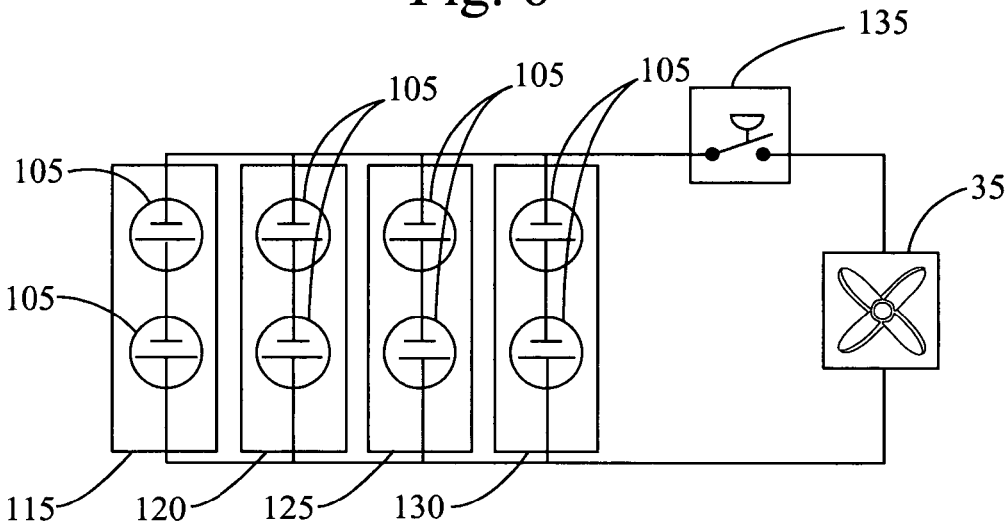
FIG. 7 is a schematic of an electrical circuit of the first preferred embodiment.

A schematic illustrating the wiring of the individual cells 105 of the ringed array 50 is provided in FIG. 7. Typically, enough cells are arranged in series to generate the necessary minimum voltage to operate the fan unit 35, but each series of cells alone may not be capable of delivering enough amperage to power the fan unit. In the schematic, four sets 115, 120, 125 & 130 of two nominal 3 volts cells are wired in series with each other. Collectively, the sets of cells produce enough amperage to operate the fan unit.

Each set of cells is positioned on a particular location on the brim 33. For Instance, the first set 115 can be located on the left front quadrant of the hat; the second set 120 can be located on the left rear quadrant; the third set 125 can be located on the right rear quadrant; and finally the fourth set 130 can be located on the right front quadrant. Accordingly, at least one set from one of the quadrants will typically be receiving direct sunlight and generating a substantial amount of electrical energy when the wearer is standing or sitting with the hat in the sun while one or more of the other sets are typically shaded by the body 15 of the hat. Collectively, however, the total output from the sets will be substantial enough to operate the fan unit 35 at a suitable speed.

For example, if a wearer is located in the northern latitudes and is facing due east in the middle to late afternoon, the third set 125 will be receiving the most direct sunlight; the fourth set 130 will be receiving slightly less as the cells may be partially shaded be the upturned edge of the brim 33; the second set 120 will be receiving less than the fourth set as some of it will be shaded by the body 15 of the hat; and finally, the first set will almost totally be shaded by the hat's body and will be receiving only indirect sunlight. The power output of the various sets will vary based on the amount of sunlight incident on the set of cells, but because of the series parallel design, sufficient energy is generated by the ringed array 50 whether or not one or more sets of cells are shaded.

The operation of the cells 105 arranged in a series parallel arrangement is contrasted with a set of solar cells all arranged in series that are situated around the brim of a hat. If the even one cell in an all series configuration is not receiving a requisite amount of direct or indirect light because it is shaded by the body 15 or brim 33 of the hat, its internal resistance will increase to such a level to will prevent the free flow of current from the other cells through it to the fan unit 35 even if the other cells are receiving ample light. This will, accordingly, prevent the operation of the fan unit, effectively disabling the active cooling functionality of the hat.

On specific type of solar cell found to be suitable for the first embodiment of the present invention is the PowerFilm solar cell # MP3-37 made by Iowa Thin Film technologies, Inc. of St. Boone, IA. While the MP3-37 solar cells are a standard product produced by Iowa Thin Film Technologies, Inc. and are provided in a rectangular form factor, they can be incorporated into a custom configuration such as the ringed array 50 or the half-ringed arrays described above. This nominal 3-volt cell produces a voltage of around 4 volts under typical conditions and has a minimum operational voltage of about 3 volts. The typical current produced by this cell is 60 milliamps with a minimum operating current of 50 milliamps. Accordingly, when arranged in series with another MP3-37 cell, the resulting set products about 6–8 volts and 50–60 milliamps of current. Accordingly, when two of more sets of this particular cell out of the four sets provided in FIG. 7 are receiving at least the requisite minimum amount of light, 6–8 volts at a current level of 0.1 to 0.12 amps are delivered to the fan. This amount of energy is more than sufficient to operate the OD4010-05 MB Orion fan described above.

Still referring to FIG. 7, a pressure switch 135 can be provided to turn the fan unit 35 on when a wearer places the fan on his/her head. Typically, the switch is located on or underneath the headband 55 and is closed only when pressure is applied to it, such as when a wearer's head 25 is pressing against the switch. It is to be appreciated that some variations of the first preferred embodiment do not incorporate the pressure switch. Certainly, since the electrical system does not utilize batteries or other power source with a finite lifespan, there is no significant detriment to permitting the fan unit 35 to run whenever the hat is in sufficient light whether or not the hat is being worn.

A Second Preferred Embodiment

Figure 6:
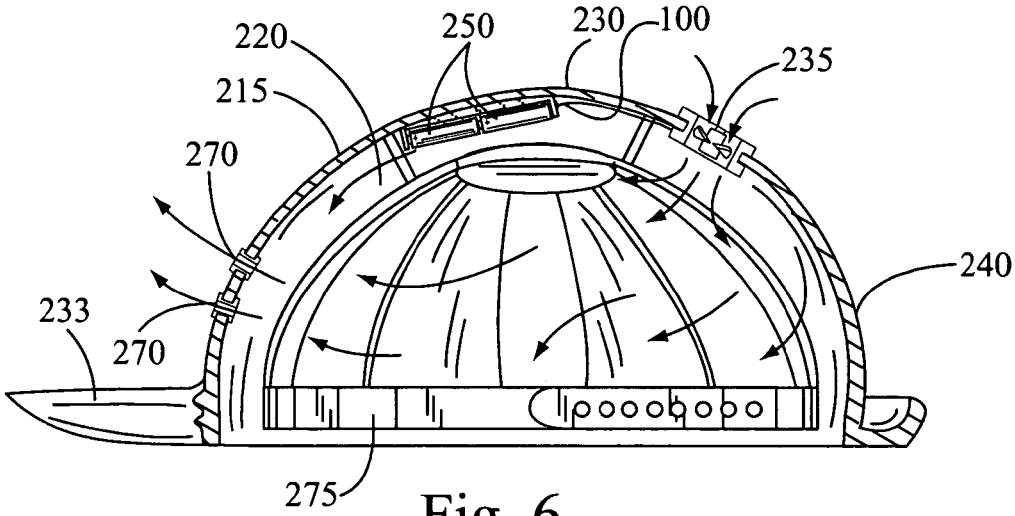
FIG. 6 is cross sectional side view of a second preferred embodiment of the present invention comprising a construction helmet incorporating a battery-powered cooling fan.

The second preferred embodiment 210 is illustrated in FIG. 6 and comprises a construction-style safety helmet incorporating a battery-powered cooling system. The helmet typically comprises: (1) a body 215 wherein a body cavity 220 is formed between the wearer's head and the topside 230 of the helmet; (2) a bill 233 extending from the front of the body to shade a wearer's eyes; (3) an encased fan unit 235 mounted to the backside 240 of the helmet configured to one of blow air into or suck air out of the body cavity; (4) one or more batteries 250 and a suitable holder electrically coupled to the fan; (5) one or both of a pressure switch 245 and a wear activated on/off switch 255; and (6) optionally, a jack 260 for plugging a battery charger into the hat.

In general, the fan unit 235 and its placement on the backside 240 of the helmet are substantially similar to the fan unit 35 and its placement described above for the first preferred embodiment. In general, the fan is attached to the backside of the helmet such that the airflow can be directed over the top of the wearer's head and through his/her hair to maximize the evaporative cooling effect. As in the first preferred embodiment, vent holes 270 may be provided in the helmet, although they are generally not required in the typically safety helmet as sufficient space is provided between the wearer's head in an adjustable headband 275 and the interior sidewalls of the helmet's body 215 to facilitate airflow. In variations of the second preferred embodiment, the encased fan can also be placed on the top of the helmet. Further, the fan unit can be placed on the front side of the helmet since fashionability is typically not an over riding concern when choosing a safety helmet.

A battery pack to power the fan can be attached to the helmet at any suitable location, although in the helmet illustrated in FIG. 6, the batteries 250 are placed in holders that extend inside an outwardly indented portion of the helmet body's topside. To power the Orin fan model # OD4010-05 MB as described above, four 1.2–1.5 volt batteries, such as AA batteries, are required. The batteries can be of any suitable type including, but not limited to, alkaline, NiCad, NiMH or lithium. When rechargeable type cells are utilized the jack 260 (see FIG. 8) may be provided in the helmet for attachment to a suitable adapter for charging the batteries without removing them from the helmet.

Figure 8:
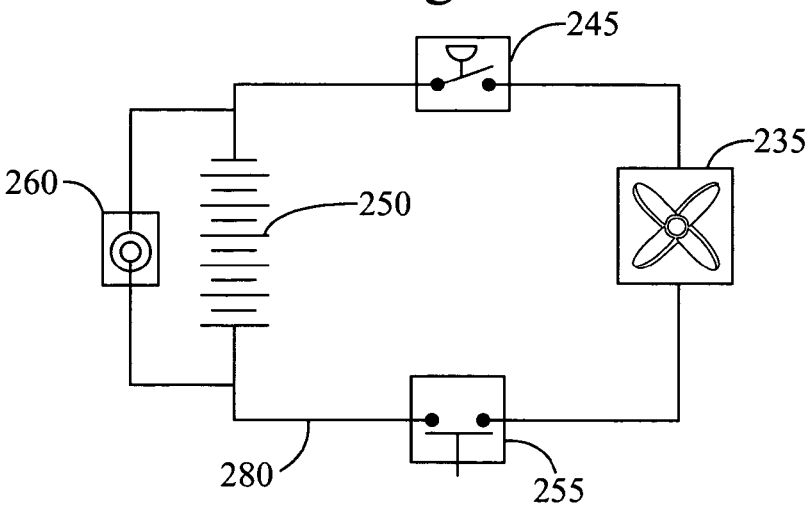
FIG. 8 is a schematic of the electrical circuit of the second preferred embodiment.

Referring specifically to FIG. 8, a typically electrical schematic of the second preferred embodiment's electrical circuit is illustrated. The batteries 150 provide power to the fan unit via electrical wiring or traces 280, and both the pressure switch 245 and the wearer operated on/off switch 255 are provided. The pressure switch is substantially similar to the one described above for the first preferred embodiment. The on/off switch is of any suitable type including, but not limited to a toggle switch, a slide switch, a rotary switch, and a rocker switch. Although both a pressure and an on/off switch are illustrated, variations of the second preferred embodiment may only incorporate one of the switch types since both perform essentially the same function of turning the fan off to prevent the batteries from being needlessly drained. The on/off switch provides the wearer with the additional advantage of being able to wear the helmet and not have the fan in operation, which might be desirable in certain situations, such as when the ambient temperature is already low enough that no additional cooling is required.

Other Alternative Embodiments

The embodiments of the headwear as illustrated in the accompanying Figures and described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, other types and styles of hats utilizing various combinations of the novel features described herein are contemplated. Further, in alternative embodiments of the present invention, the hats may utilize either a battery powered or a solar powered power source or both in combination. Other embodiments of the hat can incorporate other cooling features such as a thermoelectric module over which the airflow is directed. The placement of the encased fan unit may vary depending on the style of the hat and its intended market. Although the backside of a hat is considered the preferred location for placing the low profile encased fan unit, certain alternative embodiments may have the fan unit placed along the a left or right side of the hat, the front side of the hat or the top side of the hat. Additionally, the types of fan units, solar cells, and batteries and their specifications may vary significantly from the particular examples provided herein.

I claim:

1. Headwear comprising:

A body portion having a topside and a backside, the body portion when the headwear is being worn adapted to (1) substantially cover the top of a wearer's head, and (2) provide a cavity between a top of a wearer's head and topside of the body portion;

A low profile encased fan unit, the low profile encased fan unit being (a) attached to the body portion, and (b) being positioned to direct airflow through the cavity.

2. The headwear of claim 1, wherein the encased fan unit is attached to the body portion at the backside of the body portion.

3. The headwear of claim 1, further comprising one or more solar cells, the one or more solar cells being attached to headwear and being electrically coupled to the encased fan unit.

4. The headwear of claim 3, wherein the headwear is a cowboy hat and includes a brim encircling the body portion.

5. The headwear of claim 4, wherein the cowboy hat is comprised of a woven material.

6. The headwear of claim 3, wherein the one or more solar cells are flexible.

7. The headwear of claim 3, wherein the one or more solar cells comprise a plurality of solar cells that are electrically coupled with the encased fan unit in a series parallel relationship.

8. The headwear of claim 3, further comprising a brim, the brim substantially encircling the body portion, and wherein plurality of solar cells comprise one of a single ringed array and a pair of half ring arrays, the one of the single ringed array and the pair of half ring arrays being attached to the brim and generally encircling the body portion.

9. The headwear of claim 1, further comprising one or more batteries, the batteries being electrically coupled to the one or more solar cells.

10. The headwear of claim 1, wherein the encased fan unit has an airflow rating of at least 1.5 CFM.

11. The headwear of claim 1, wherein the encased fan unit has a static pressure rating of at least 0.05" of water.

12. Headwear comprising:

a body portion having a top side, a back side and a front side;

a brim generally surrounding the body portion;

a low profile encased fan attached to the body portion; and an array of solar cells attached only to a top surface of the brim, and being electrically coupled to the fan;

wherein the low profile encased fan has a rotor, impellers and a motor, the rotor, the impellers and the motor all being substantially enclosed in a casing of the fan, and wherein the electrical motor includes windings and associated magnets, the windings and associated magnets are located at axial positions substantially directly radially underlying the rotor and the impellers.

13. The headwear of claim 12, wherein the array of solar cells comprises at least a first set of two or more solar cells electrically coupled in series, and a second set of two or more solar cells electrically coupled in series, wherein (1) the first and second set are electrically coupled with each other in parallel, and (2) the first set is attached to the brim proximate one side of the body portion and the second set is attached to the brim proximate another side of the body portion generally opposite the one side.

14. The headwear of claim 12, wherein the array of solar cells comprises flexible thin film solar cells.

15. The headwear of claim 14, wherein the array of solar cells is arranged generally in a ringed configuration on the brim around the body portion.

16. Headwear comprising:

a body portion having a front side, a back side and a top side;

a brim extending substantially around the body portion;

an low profile encased fan unit, the fan unit being attached to the back side of the body portion and being adapted to provide airflow in an interior of the body portion; and a plurality of thin film flexible solar cells arranged around a surface of the brim.

17. The headwear of claim 16, wherein the plurality of solar cells comprise a ringed array.

18. The headwear of claim 16, wherein the body portion and the brim are substantially black.

* * * * *